United States Patent [19]

Fukushima et al.

[11] 3,966,375

[45] June 29, 1976

[54] RAIL MOUNTED APPARATUS FOR MANUFACTURING CONCRETE POLES

[75] Inventors: Yoshikiyo Fukushima, Tokyo; Kenzo Momota; Hideaki Shirahata, both of Kawasaki; Noriyuki Sakanai, Kashiwa, all of Japan

[73] Assignee: Nippon Concrete Industries, Co., Ltd., Tokyo, Japan

[22] Filed: July 30, 1974

[21] Appl. No.: 493,054

[30] Foreign Application Priority Data

Feb. 12, 1974 Japan ..... 49-16167

[52] U.S. Cl. ..... 425/62; 425/88; 425/454; 425/DIG. 201

[51] Int. Cl.[2] ..... B28B 5/04

[58] Field of Search..... 425/88, 404, 435, 445–446, 425/453–455, DIG. 200–DIG. 201, 62

[56] References Cited

UNITED STATES PATENTS

| | | | |
|---|---|---|---|
| 1,641,583 | 9/1927 | Hanley, Jr. | 425/404 |
| 2,596,052 | 5/1952 | Stockmar | 425/453 |
| 2,949,655 | 8/1960 | Berumen et al. | 425/435 |
| 3,032,851 | 5/1962 | Gibbs | 425/88 |
| 3,344,492 | 10/1967 | Eggeling et al. | 425/455 |
| 3,384,939 | 5/1968 | Baker | 425/404 |
| 3,523,343 | 8/1970 | Mitchell | 425/453 |
| 3,525,131 | 8/1970 | Schneider et al. | 425/88 |
| 3,732,052 | 5/1973 | Gunia | 425/88 |
| 3,825,394 | 7/1974 | Pietrowiak | 425/404 |

FOREIGN PATENTS OR APPLICATIONS

| | | | |
|---|---|---|---|
| 1,070,164 | 6/1967 | United Kingdom | 425/446 |

*Primary Examiner*—Francis S. Husar
*Assistant Examiner*—John McQuade
*Attorney, Agent, or Firm*—Oblon, Fisher, Spivak, McClelland & Maier

[57] ABSTRACT

This invention relates to an apparatus for manufacturing concrete poles which has a train system running on a rail and stays on a required place to manufacture concrete poles, and is characterized in comprising at least a wire storage device, a caging stand, a mold traverser, a spinning machine and a device for carrying materials or products.

2 Claims, 4 Drawing Figures

RAIL MOUNTED APPARATUS FOR MANUFACTURING CONCRETE POLES

SUMMARY OF THE INVENTION

This invention relates to an apparatus, for manufacturing concrete poles, movable on a rail. Concrete piles and concrete poles are large and heavy, and it is therefore difficult to carry them. Moreover they are used in places along railways very far from cities for the purpose of building railway bridges and standing power transmission poles for railways. Therefore it is required to use a movable apparatus for manufacturing concrete poles utilizing a railway, so that required concrete poles may be manufactured thereon and remain temporarily in some place along the railway, and thereafter the apparatus may be moved to another place to do the same work.

The object of this invention is in the use in the establishment of railways and construction of railways over a large area. Furthermore it is more convenient to install facilities necessary for workers' life on cars together with many facilities for manufacturing. It is also easily possible to add an apparatus for manufacturing other concrete products, for example concrete piles, as well as concrete poles.

Other objects and features of this invention will become apparent by the two embodiments described in the following according to the accompaying drawings.

BRIEF DESCRIPTION OF THE DRAWINGS

Accompanying drawings show the two embodiments of this invention.

Figure 1:
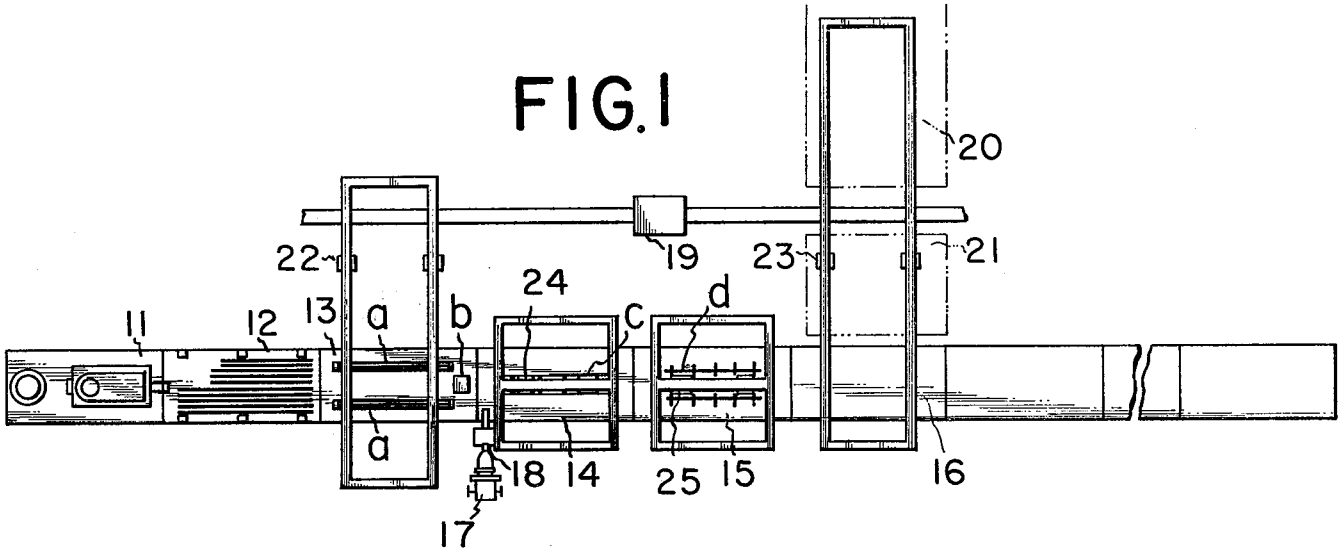
FIG. 1 is a plan view showing the first embodiment.

Nos. and characters in the drawings show the following parts respectively;

| | |
|---|---|
| 11. boiler, | 12. wire storage device, |
| 13. caging stand, | 14. molding shop car, |
| 15. spinning machine car, | 16. empty car, |
| 17. concrete mixer car, | 18. concrete supplying device, |
| 19. mold traverser, | 20. demolding shop car, |
| 21. steam curing room, | 22. mono-rail hoist, |
| 23. mono-rail hoist, | 24. mono-rail hoist, |
| 25. mono-rail hoist, | 14'. molding-and-carrying car, |
| 26. steam curing car, | 27. demolding car, |
| 28. product carrying car, | 29. travel lift, |
| 30. travel lift, | a. wire caging machine, |
| b. upsetter, | c. mold, |
| d. spinning machine, and | e. guide rail. |

DETAILED DESCRIPTION OF THE INVENTION

Figure 2:
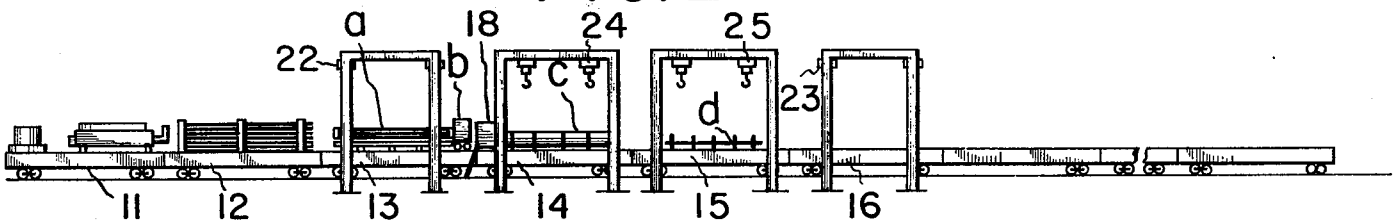
FIG. 2 is a side elevation view of the same.

FIG. 1 is a plan view showing the first embodiment of this invention. FIG. 2 is a side elevation of the same. In the first embodiment, a carrying device is stationary, and the operation is done as the devices are moved by a tractor. In FIG. 1, 11 is a boiler, 12 is a wire storage device, 13 is a caging stand on which two wire caging machines *a*,*a* and an upsetter *b* are installed, 14 is a molding shop car and *c* is a mold. 15 is a spinning machine car on which a spinning machine *d* is installed and 16 represents empty cars tied to each other and put on the rails. 17 is a concrete mixer car which supplies concrete to the molding shop car 14 through a concrete supplying device 18. 19 is a mold traverser, 20 is a demolding shop car, 21 is a steam curing room and 22, 23, 24 and 25 are mono-rail hoists fixed on the ground.

Working condition of the above apparatus will be explained in the following. First, a lower part of an empty mold on the mold traverser 19 is put on the molding shop car 14 by a mono-rail hoist 22. At that time a tractor, not shown, is used to put it on the required place. A wire cage made by the wire caging machine *a* on the caging stand 13 is lifted by the mono-rail hoist 22, and is put inside the lower part of an empty mold *c* on the molding shop car 14 placed just under the cage by the tractor. Then concrete is supplied to the cage inside the lower part of the empty mold *c* through the concrete supplying device 18 from the concrete mixer car 17. In this case, the cars are moved gradually by the tractor so that concrete is supplied equally over the full length of the mold. After the completion of the concrete molding, an upper part of the mold provided on the mold traverser 19 is covered. As required a tensioning operation of the wire is done, by means, not shown, and thereafter it is lifted up by the mono-rail hoist 24. Then the spinning machine car 15 is moved just under the mono-rail hoist 24, after that the said mold hanging by the mono-rail hoist 24 is put on the spinning machine *d*. Simultaneously a lower part of an empty mold on the mold traverser 19 is carried by the mono-rail hoist 22 to put on the molding shop car 14.

The mold for which the spinning operation was done is hung by the mono-rail hoist 25, and at the time of putting an empty mold on the molding shop car 14, the spun mold is put on an empty car 16 provided on the right hand side. The car 16 is moved by the tractor just under the mono-rail hoist 23. By means of the mono-rail hoist 23 the spun mold on the car 16 is placed in the steam curing room 21. The steam curing operation is done by covering the room with a sheet and supplying steam from the boiler 11. After the completion of the steam curing, the mold is carried to the demolding ship car 20 by the mono-rail hoist 23, and the demolded mold is replaced on the mold traverser 19.

The above steps are repeated until required numbers of concrete poles are manufactured at the required place aong the railway. After completing the whole operation, all the facilities are put on cars and moved by the tractor to another required place to do the same operation.

Figure 3:
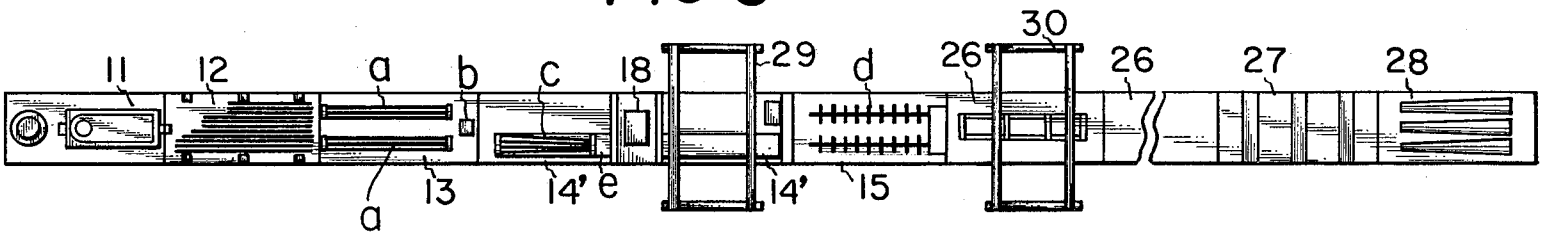
FIG. 3 is a plan view showing the second embodiment.
Figure 4:
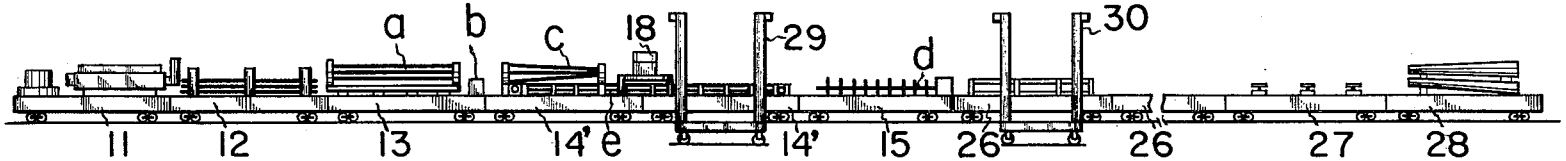
FIG. 4 is a side elevation view of the same.

FIGS. 3 and 4 show the second embodiment. In the second embodiment, a travel lift, which is movable along the rail, is used, so that it is not necessary to move the cars during operation.

In the drawings, the same numbers and characters show the same as in the first embodiment. 11 is the boiler, 12 is the wire storage device, 13 is the caging stand on which two wire caging machines *a*, *a* and an upsetter *b* are installed, and 15 is the spinning machine car on which the spinning machine *d* is installed. 14' represents molding-and-carrying cars which are connected to each other and have a concrete supplying device 18 at the center and a guide rail e. to move a mold. 26 is a steam curing car, 27 is a demolding car, 28 is a product carrying car, and 29 and 30 are travel lifts having tyre-type wheels which are able to run by themselves on the ground.

Working condition of the above apparatus will be explained in the following. Wires on the wire storage device 12 are carried to a caging stand 13 so as to be made into a wire cage by wire caging machines *a*, *a* and an upsetter *b*. The wire cage is put into the lower part of a mold *c* previously provided by a travel lift 29 on the guide rail *e* on molding-and-carrying cars 14'. The mold *c* is moved gradually on the guide rail *e* by the travel lift 29, and passes under the concrete supplying device 18 which supplies concrete from the concrete mixer car (not shown) equally over the full length of the mold. After the completion of the concrete molding, the upper part of the mold is covered and subsequently, the covered mold is carried to the spinning machine car 15 by the travel lift 29 after a tensioning operation of the tension wires is done as required by means, not shown. On the car 15 the mold is fastened by the spinning machine *d*, and then it is carried to a steam curing car 26 by the travel lift 30 to undergo steam curing by steam from the boiler 11. Thereafter it is carried to the demolding car 27 by the travel lift 30 to be demolded. The mold *c* is replaced on the molding-and-carrying cars 14' and the product is carried to the product carrying car 28 by the travel lift 30. As mentioned above, any car does not have to be moved during the operation in the second embodiment, therefore during the operation a tractor is not used.

Two embodiments of this invention have been explained hereinbefore. However, the present invention is not limited to the above two embodiments Some modifications are possible within the range of the idea of the invention.

According to the present invention, transportation problems of concrete poles, whether large, long or heavy, is solved. Concrete poles can be manufactured easily at the optional place near the place using the product. Very practical effect can be displayed especially in the railway construction or electrification construction in the area having a wide expanse.

We claim:

1. Movable apparatus, for manufacturing concrete poles, which includes a train of cars movably running on rails, comprising:

a boiler car having a boiler disposed thereon for supplying steam for use in a curing operation of said concrete poles;

a wire storage car connected to said boiler car having wires stored thereon for use in forming a wire cage for said concrete poles;

a caging stand car connected to said wire storage car having wire caging machines and an upsetter device disposed thereon for fabricating reinforcing wire cages from said stored wires;

a molding shop car connected to said caging stand car having a mold disposed thereon, for receiving said wire cage therewithin, and concrete supply means secured thereto for supplying concrete to said mold;

a spinning machine car connected to said molding shop car having a spinning machine disposed thereon for spinning said mold when charged with concrete;

at least one empty car connected to said spinning machine car for receiving said mold therefrom subsequent to a spinning operation;

a steam curing room disposed adjacent to said empty car for receiving said mold therefrom and having means disposed thereon for curing said concrete therewithin in the presence of steam supplied to said curing room from said boiler;

a demolding shop car disposed adjacent to said curing room for receiving said concrete poles when the same are removed from said mold after said curing operation;

a tractor connected to said train at one end thereof for moving said cars along said rails;

a mold traverser mounted upon a supplementary rail dispposed parallel to said train rails; and a plurality of mono-rails hoist means mounted upon rails disposed transversely of said train rails and said supplementary rail, said demolding shop car and said steam curing room being disposed beneath one of said hoist means, whereby said hoists can move said molds between said train, disposed upon said train rails, and said traverser, as well as between said train and said steam curing room and said demolding shop car.

2. Movable apparatus, for manufacturing concrete poles, which includes a train of cars movably running on rails, comprising:

a boiler car having a boiler disposed thereon for supplying means for use in a curing operation of said concrete poles;

a wire storage car connected to said boiler car having wires stored thereon for use in forming a wire cage for said concrete poles;

a caging stand car connected to said wire storage car having wire caging machines and an upsetter device disposed thereon for fabricating reinforcing wire cages from said stored wires;

molding-and-carrying cars connected to said caging stand car having a guide rail disposed thereon, a mold, for receiving said wire cage therewithin, movably mounted upon said guide rail, and a concrete supply device mounted thereon at the central portion thereof and disposed above said guide rail and mold for supplying concrete to said mold;

a spinning machine car connected to said molding-and-carrying cars having a spinning machine disposed thereon for spinning said mold when charged with concrete;

a steam curing car connected to said spinning machine car for receiving said mold therefrom and having means disposed thereon for curing said concrete therewithin in the presence of steam supplied thereto from said boiler;

a demolding car connected to said steam curing car for receiving said concrete poles when the same are removed from said mold after said curing operation;

a product carrying car connected to said demolding car for receiving therefrom said cured poles; and a plurality of travel lift means, having tire-shaped wheels and movable in a direction parallel to said rails and upon the ground, for transporting said cage, said mold, and said poles between said cars.

* * * * *